US006463751B1

(12) United States Patent
Teller

(10) Patent No.: US 6,463,751 B1
(45) Date of Patent: Oct. 15, 2002

(54) AC SYSTEM UTILIZING CONDENSATE WATER TO PRECOOL HOT GAS

(76) Inventor: Kevin Teller, 330 William St., Port Chester, NY (US) 10573

( * ) Notice: Subject to any disclaimer, the term of this patent is extended or adjusted under 35 U.S.C. 154(b) by 0 days.

(21) Appl. No.: 09/711,679

(22) Filed: Nov. 9, 2000

(51) Int. Cl.[7] ..... F28D 5/00
(52) U.S. Cl. ..... 62/305
(58) Field of Search ..... 62/305

(56) References Cited

U.S. PATENT DOCUMENTS 3,811,293 A * 5/1974 Flynn ..... 62/280
3,872,684 A * 3/1975 Scott ..... 62/181
5,682,757 A * 11/1997 Peterson ..... 62/259.2
5,816,318 A * 10/1998 Carter ..... 165/110
5,979,172 A * 11/1999 Teller ..... 62/305
5,992,171 A * 11/1999 Bacchus ..... 62/305

* cited by examiner

*Primary Examiner*—William C. Doerrler
*Assistant Examiner*—Mark Shulman
(74) *Attorney, Agent, or Firm*—Serle Ian Mosoff

(57) ABSTRACT

Disclosed is a high efficiency whole house or building air conditioner utilizing condensate water dripped onto the condenser to subcool the heat exchange fluid in the condenser.

2 Claims, 2 Drawing Sheets

AC SYSTEM UTILIZING CONDENSATE WATER TO PRECOOL HOT GAS

BACKGROUND

In a modern air conditioning system a heat exchange fluid, typically a form of Freon in a home or small commercial system, circulates in a closed system comprising a compressor, a first heat exchanger [condenser], a flow restriction and second heat exchanger called an evaporator. The heat exchange medium is compressed in the compressor and exits in the vapor phase at high temperature [from heat of compression] and high pressure. This returning gas flows to the outdoor heat exchanger or condenser, a series of coils containing the Freon or other heat exchange medium where air from outside the area to be cooled flows across the hot gaseous fluid containing coils and extracts heat from the fluid causing the fluid to condense to the liquid phase as it progresses through the coil, becoming totally fluid before the end of the coil. The remainder of the coil is used to subtract additional heat [subcool] from the Freon before it leaves the condenser via the liquid line.

The fluid, now at ambient temperature in liquid phase and still at high pressure, enters the flow restriction. It expands as it exits the flow restriction. As a result of expansion and vaporization, the fluid exits as a mixed liquid/vapor at low temperature and pressure.

The fluid then enters the evaporator, a series of coils where a fan causes the hot air to be cooled to flow over the coils thereby transferring heat from the hot air to the fluid and changing it to the vapor phase as it warms. The low-pressure fluid travels to the compressor where the compressor pumps the returning fluid to the condenser, where outside air is drawn across it by a fan as the cycle begins again.

In a central air conditioning system, the air contained in the space to be cooled is moved through a return air duct by a fan located in the air-handling unit and then through an evaporator where the air is both cooled and dehumidified. The conditioned air is then distributed through the supply ductwork back to the space and the cycle repeats itself until the desired conditions are obtained. In a room air conditioner the air flowing across the evaporator is discharged directly into the room.

Various types of coolant fluids are in use to cool the air, such as Freon, water, or a water-gylcol mix.

As the hot room air passes over the evaporator coils and is cooled it is no longer able to hold the quantity of moisture present as water vapor. Droplets of liquid water condense on the surface of the evaporator coils. This condensate water, typically at a temperature of about 40° F., falls from the coils by gravity and is collected, typically in a drip pan. The condensate must be disposed of either by channeling it to a remote drain [in a central air conditioning installation] or by letting it drip from the unit in the case of a window or wall or transom mounted unit.

The oil or gas shortage of 1974 started the process of increasing air conditioner efficiency. Even so, until about 1980 there was no particular concern about the cost of running an air conditioner, as prices in general were fairly low. Air conditioners then began to be designed with efficiency considerations in mind, using fewer or lighter materials, in an attempt to obtain more BTU's/unit of electricity. Electric motors and compressors became smaller and lighter and drew less amperage, becoming more efficient due to advances in electrical engineering. An orifice, an advanced metering device, was designed which would allow a lower head pressure or condensing pressure to be used, which in turn lowered the electric draw the compressor used. In conjunction with this, more coil surface is now used in the condenser to lower head pressure and provide more subcooling of the liquid Freon.

Over the years different various more effective heat transfer fluids were developed. Time delay relays were also developed which delay the evaporator fan [inside fan] from turning on until the compressor runs for about 30 to 60 seconds to start the Freon moving through the inside coil, and which extend fan operation on shutdown for approximately 30 to 60 seconds to take advantage of the Freon still evaporating.

In window units, slingers are in use which throw condensate water onto the condenser coil to help transfer heat in conjunction with the outside air blown across the coil by the fan. This technique helps increase efficiency but not enough of the water hits the hot gas line to evaporate sufficient amounts of the condensate water to eliminate condensate disposal problems. The unevaporated water drains down the coil picking up heat and is warm when it reaches the drain pan from which the slinger draws water. Over a short period of time the water in the pan is warmed so that the efficiency of heat transfer decreases substantially. This results in the liquid line temperature approximating that of the environment, even though the slinger does a good job of cooling the condenser coil.

Attempts have been made to increase efficiency by running the liquid line [usually approximately 2 feet of plain copper tube] through the condensate water drain pan but this provides little benefit because the water is warm. Even were the water cool, the plain copper tube doesn't act as an effective heat exchanger. A copper tube run through the drain pan in a central unit doesn't work for the same reason.

Water cooled condensers were developed early on and are in use in commercial applications using cooling towers, but the use of water cooled condensers increases the cost of operations.

Among the improvements that have been implemented is the addition to the system of a small heat exchanger, which coils the liquid line around the suction line, subcooling the liquid line while also boiling off any droplets of Freon still remaining in the suction line. This however does not increase the efficiency of the unit as energy is just transferred from one line to the other and was used mainly to protect the compressor from unevaporated droplets of Freon, or in some cases to cool the liquid line.

Wachs III, et al, U.S. Pat. No. 5,113,668, issued May 19, 1992, utilizes an evaporative sub-cooler downstream of the condenser between the condenser and the expansion device to subcool the refrigerant for increased system efficiency. Wachs III also includes a counter-flow heat exchanger in the liquid zone adjacent to the subcooler to provide additional subcooling and also provide for warming of the cooling water.

Peterson, U.S. Pat. No. 5,682,757, issued Nov. 4, 1997 discloses a liquid management system for air conditioners where condensate water is collected and is distributed to selected system component[s] such as electronic system controllers, electric motors, condenser fan or condenser and microprocessors. Similarly to Wachs III et al., Peterson discloses using the condensate to subcool the liquid line between the condenser and evaporator.

Cooper, U.S. Pat. No. 5,419,147, issued May 30, 1995 discloses a method of reducing the temperature of air passing over the condenser surface by applying water to the entire surface of the condenser. Several problems exist with prior art systems such as that disclosed by Cooper. These systems require a pump and control valves to control the application of water, requires an excess of water to minimize deposit of inorganic residues present in the water. Most importantly, these systems add additional costs of operation and do not take advantage of the cooling effect of condensate water.

In light of the expressed needs of users, it is an object of this invention to further increase the efficiency of current central air conditioning systems.

It is a further object of this invention to add cooling capacity to or to retain full capacity of central air conditioning systems in humid weather by recovering the energy in the condensate water.

It is a further object of this invention to remove the problems associated with the disposal of condensate water from central air conditioning units.

SUMMARY OF THE INVENTION

I have now discovered a novel technique for utilizing waste condensate water from central air conditioning systems to increase the efficiency of the system by subcooling the heat exchange fluid in the system utilizing the cooling capacity of condensate water produced by the air conditioning unit.

My technique for increasing the efficiency of air conditioning systems utilizes the cooling values of condensate water by heat exchanging the cold condensate water with the heat exchange medium utilized in an air conditioning system. Unlike prior art systems which insert an auxiliary heat exchanger in the liquid line or in the hot gas line, my invention simply subcools the heat exchange fluid in the condenser by dripping condensate water over the coils of the condenser while the system is running.

With ever-increasing energy costs it is desirable to increase the efficiency of air conditioning units by not wasting any of the possible sources of cooling. Condensate water is a currently wasted source of cooling in residential and mobile environments. Cold condensate water [45°–55° F.] may be used to take advantage of a free cooling effect it can offer which in turn yields more efficient system.

The condensate can be put to use in various ways to provide a means of extracting heat from the Freon or other heat exchange fluid in the condensing unit instead of being wasted, providing a higher efficiency rating of the system and/or maintaining full capacity in hot humid weather when the greatest demand is placed on the system. This can be of greatest benefit in hot humid areas where large amounts of condensate are produced, or where unconditioned outside air is constantly being introduced to the system.

In a central air conditioning unit, a technique to recapture a benefit from the condensate is to let the condensate from the evaporator drip onto the condenser coil itself. This may be accomplished by any conventional means, such as by means of a trough around the top of the unit. A small indentation around the bottom of the coil would catch any condensate if the system shuts off so the water can continue to drain and be utilized during the next cycle.

The more the Freon is subcooled the more heat it can extract once it is in the evaporator coil. Outside air temperature is the lowest temperature it can be subcooled to so as outside air temperature rises, so also does the liquid line temperature; and a corresponding drop in efficiency results. A mist of cold water sprayed or slung onto the condenser increases the efficiency of the unit by extracting more heat from the Freon, subcooling the liquid below air temperature, allowing the colder Freon to pick up more heat from the inside coil. Unfortunately water costs are too high for use of introduced coolant water to be economically feasible and electrically operated slingers or like means of forcing the water onto the surface of the condenser increase production and maintenance costs. However, condensate water can take the place of applied cooling water, is a free source of subcooling, is always wasted and does not require the use of control valves or electric motors.

DETAILED DESCRIPTION

Figure 1:
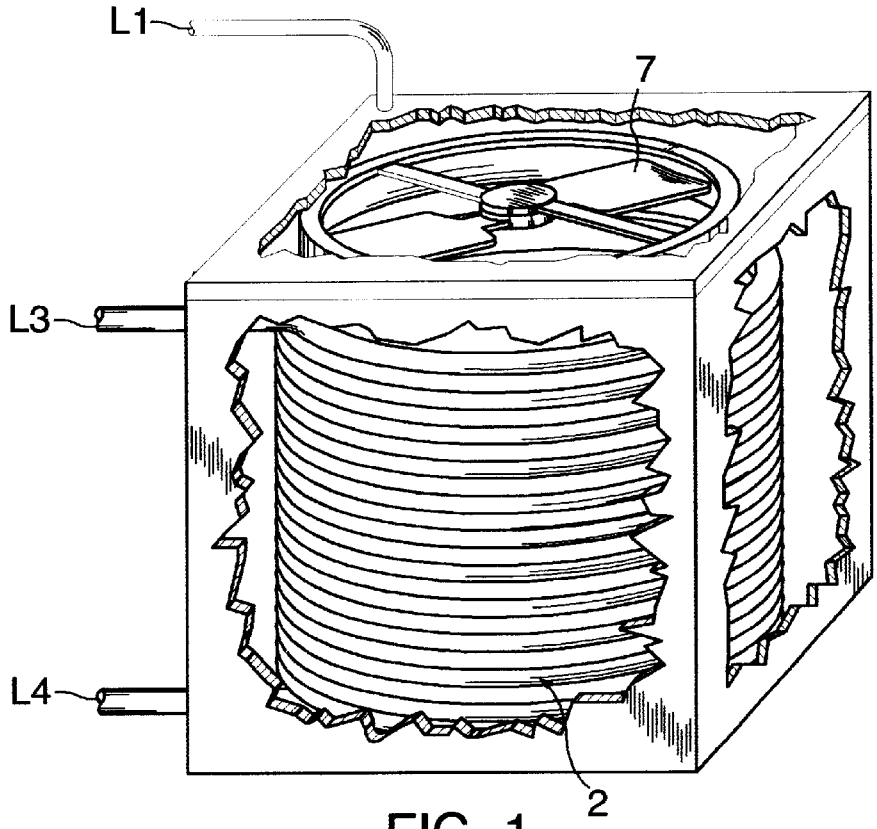
FIG. 1 depicts the condenser unit 1 of a high efficiency central air conditioning system embodiment of the invention. A heat exchange fluid, typically Freon is contained in lines L3 and L4. Hot gaseous Freon flows in line L3 through condenser 2 where ambient temperature air is forced through the coils of condenser 2 by fan 7, cooling the hot Freon and converting it to liquid form before it exits. Condensate water collected from the evaporator section of the air conditioning system enters the condenser unit 1 via line L1 positioned at the top of the condenser unit.
Figure 2:
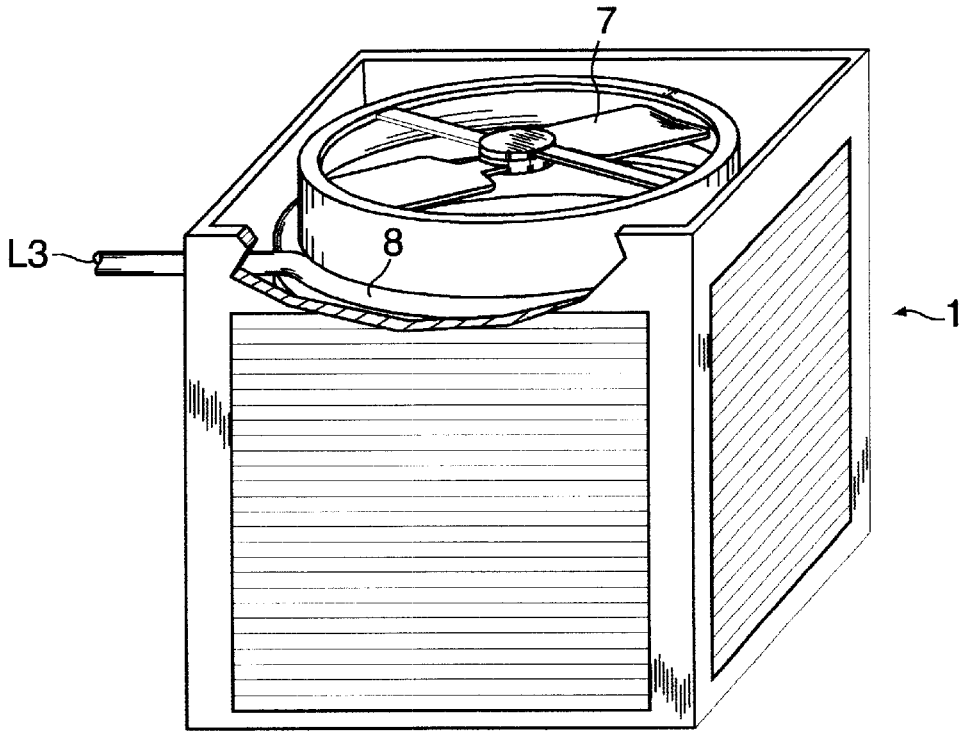
FIG. 2 is a top view of the condenser unit 1 of a central air conditioning system with the top cover removed showing fan 7, the top coil 8 of the condenser 2, and the hot gaseous Freon line L3.
Figure 3:
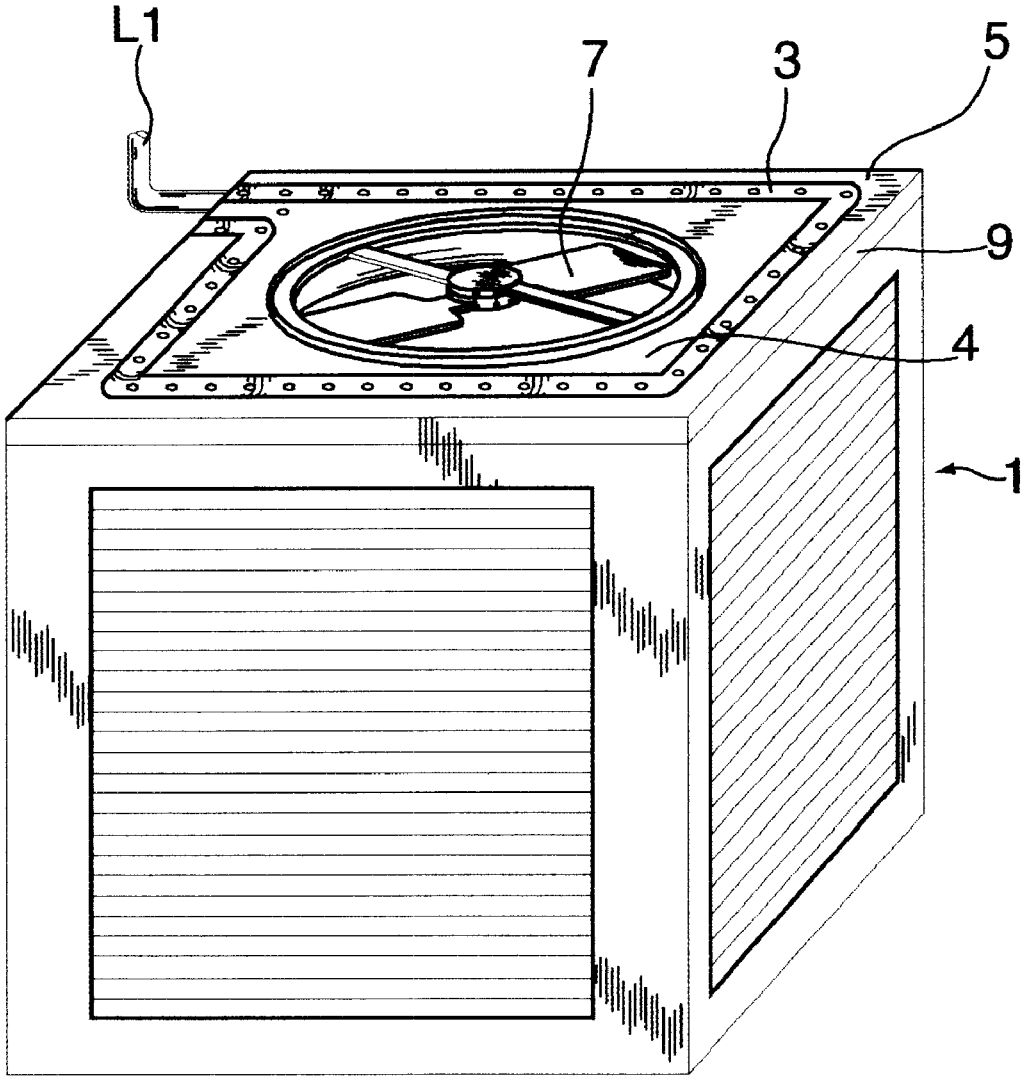
FIG. 3 depicts an embodiment of the invention where condensate water enters through line L1 into a top panel 9 shaped to be mounted on the condenser unit 1 beneath the standard top panel of the condenser unit 1. Top panel 9 contains a trough portion 3, containing a multiplicity of drain holes, flat solid portions 4 and 5 and a central cut out portion 3 which permits ambient temperature air to be forced out the top of the unit by fan 7.

An air conditioning system can be made more efficient by subcooling the liquid Freon below the outdoor temperature by as much as 40° F. on a 90° F. day thereby reducing the amount of flash gas and allowing a much higher percentage of the Freon to be used as effective latent heat. This is beneficial because it will permit the use of less Freon or lower pressure, each of which will result in a more efficient unit.

For example, the typical evaporator operating pressure is 68 psi. This equates to a temperature of about 40° F. if the outdoor temperature is 90°–98° F., which is fairly common in many areas. Flash gas must cool that 90°–98° F. Freon down to 40° F. before any effective heat removal begins. If the Freon is subcooled to 60° F. that would eliminate 30–40° F. worth of flash gas cooling. A reduction in Freon temperature below 60° F would provide even better results.

The most important element in maintaining high efficiency is the flow rate of the fluids. To provide the highest efficiency, the coolant fluid, condensate water, must be present and flow over the hot encased Freon is a quantity sufficient to extract a reasonable quantity of heat during the limited period of contact. In instances where no condensate water is present the efficiency of the air conditioner will not be increased, as no subcooling will take place. Nor, however, will the efficiency be decreased, as there is no energy penalty during the time heat transference is not occurring.

The condensate water dripping off the evaporator coil is routed to the condenser and distributed by any convenient means, such as a baffle or plate with holes, or a modified top cover, over a substantial portion of the top of the outside AC unit containing the condenser. An electrically operated slinger may also be used. After heat exchange all or a substantial portion of the liquid condensate is vaporized. Any remaining unvaporized condensate water is allowed to drain onto the ground.

My invention is further explained in the following non-limiting example.

EXAMPLE

This Example tests the effect on system pressure of dropping a small amount of condensate water [simulated] on the condenser coil of a central air conditioning unit. Using 73° F. water sprinkled sparingly on the coil the pressure dropped from 250 psi down to 225 psi. Using 55° F. water the pressure dropped from 250 psi to 215 psi.

I claim:

1. In a high efficiency central air conditioner comprising a heat exchange fluid, a compressor, a hot gas line connecting the compressor to a condenser, a condenser, at liquid line connecting the condenser to an expansion device, an expansion device, a line connecting the expansion device to an evaporator, an evaporator and a vapor line connecting the evaporator to the compressor, the improvement comprising subcooling the condenser where the coolant fluid utilized to subcool the condenser is condensate water produced by the evaporator and where the condensate water is provided to the condenser through a top panel covering the condenser unit, such top panel comprising a solid portion, a central cutout which permits ambient air to be forced out the top of the unit, and a trough containing a multiplicity of drain holes positioned such that condensate water dripping through the drain holes contacts the condenser coils.

2. The improved high efficiency air conditioner of claim 1 wherein the condensate water produced by the evaporator is substantially completely evaporated by utilizing it to subcool the heat exchanger fluid in the condenser.

* * * * *